US007668481B2

(12) United States Patent
Kawai

(10) Patent No.: US 7,668,481 B2
(45) Date of Patent: Feb. 23, 2010

(54) DEVELOPING DEVICE AND IMAGE FORMING DEVICE INCLUDING A SEAL MEMBER

(75) Inventor: Hideaki Kawai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 563 days.

(21) Appl. No.: 11/466,790

(22) Filed: Aug. 24, 2006

(65) Prior Publication Data

US 2007/0053713 A1 Mar. 8, 2007

(30) Foreign Application Priority Data

Sep. 2, 2005 (JP) ..... 2005-254417

(51) Int. Cl.
*G03G 15/08* (2006.01)

(52) U.S. Cl. ..... 399/103; 399/105; 399/274

(58) Field of Classification Search ..... 399/103, 399/105, 274, 284
See application file for complete search history.

(56) References Cited

U.S. PATENT DOCUMENTS

| | | | |
|---|---|---|---|
| 5,134,960 A | 8/1992 | Shirai | |
| 5,697,021 A | 12/1997 | Watanabe et al. | |
| 6,181,897 B1 | 1/2001 | Kawai | |
| 6,321,050 B1 * | 11/2001 | Sato et al. | 399/103 |
| 2005/0180774 A1 | 8/2005 | Ohgoshi et al. | |

FOREIGN PATENT DOCUMENTS

| | | |
|---|---|---|
| EP | 0400557 A2 | 12/1990 |
| JP | 03-131877 A | 6/1991 |
| JP | 2000-131940 A | 5/2000 |
| JP | 2001-051563 A | 2/2001 |
| JP | 2001-060038 A | 3/2001 |
| JP | 2001-060041 A | 3/2001 |

OTHER PUBLICATIONS

Official communication issued in counterpart Japanese Application No. 2005-254417, mailed on Feb. 24, 2009.
Official communication issued in the counterpart European Application No. 06016583.4, mailed on Jan. 31, 2007.

* cited by examiner

*Primary Examiner*—David M Gray
*Assistant Examiner*—Laura K Roth
(74) *Attorney, Agent, or Firm*—Keating & Bennett, LLP

(57) ABSTRACT

A regulating member includes a protrusion protruding from a supporting member toward a developing roller. The length of the supporting member in the longitudinal direction is longer than the length of the protrusion in the longitudinal direction. A seal member includes an extending portion extending from a space for carrying developing agent. The extending portion is turned backward along an end of the regulating member with respect to the longitudinal direction thereof toward the supporting member.

12 Claims, 9 Drawing Sheets

DEVELOPING DEVICE AND IMAGE FORMING DEVICE INCLUDING A SEAL MEMBER

BACKGROUND OF THE INVENTION

1. Field of the Invention

The present invention relates to a developing device and an image forming device. More specifically, the present invention relates to an improvement for preventing leaking of developing agent.

2. Description of the Related Art

A prior art device in which leak preventing members for developing agent (including toner and carrier) are provided in the vicinity of both ends of a developing roller is known. In this prior art device, the leak preventing member for the developing agent includes a side seal as a base member and felt as an uppermost layer.

A cleaning blade is used for scraping out remaining toner adhered on a photosensitive body. Blade end seals are fixed to ends of the cleaning blade with respect to the longitudinal direction thereof.

A structure of the developing device in the prior art will be described as an example. FIG. 8 is a cross-sectional view showing the structure in the vicinity of an end of a developing roller 42 that defines the developing device with respect to the longitudinal direction thereof. FIG. 9 is a perspective view showing the structure in the vicinity of the end of the developing roller 42 with respect to the longitudinal direction. As shown in FIG. 8 and FIG. 9, the developing device mainly includes the developing roller 42, a blade 61, a bracket 62 and a seal member 63. The developing roller 42, the blade 61, the bracket 62 and the seal member 63 are stored in a housing (not shown) of the developing device.

The developing roller 42 is a rotating roller for causing the developing agent to adhere on an outer surface of the developing roller 42 by a magnetic force. The blade 61 is a regulating member for regulating the layer thickness of the developing agent adhered on the outer surface of the developing roller 42. As shown in FIG. 9, the blade 61 is provided in parallel with the longitudinal direction of the developing roller 42.

The bracket 62 supports the blade 61. As shown in FIG. 9, the bracket 62 is longer than the length of the blade 61 in the longitudinal direction. The blade 61 is mounted to the bracket 62 so that a protrusion 61*d* protrudes toward the developing roller 42 as shown in FIG. 9.

The seal member 63 is a member for preventing the developing agent from leaking from positions near the ends of the developing roller 42 with respect to the longitudinal direction. As shown in FIG. 9, the seal member 63 is provided in the vicinity of the end of the developing roller 42 with respect to the longitudinal direction. As shown in FIG. 8, the seal member 63 is mounted on an inner surface 43*a* of the housing so that the height of an upper end surface of the seal member 63 is substantially flush with the height of a lower surface of the bracket 62.

However, the developing device having the structure as described above has the following problem. That is, as shown in FIG. 9, a gap 61*b* is defined at a position surrounded by the outer surface of the developing roller 42, the protrusion 61*d* of the blade 61, the bracket 62 and the seal member 63. Consequently, the developing agent leaks from the gap 61*b*.

SUMMARY OF THE INVENTION

In order to overcome the problems described above, preferred embodiments of the present invention provide a developing device for developing an electrostatic latent image formed on a photosensitive body. The developing device includes a housing, a developing roller, a regulating member, a supporting member, and a seal member. The developing roller is provided along a wall in the housing and holds developing agent on an outer surface by a magnetic force. The regulating member is provided along the longitudinal direction of the developing roller and regulates the layer thickness of the developing agent held on the outer surface of the developing roller. The supporting member is provided along the longitudinal direction of the developing roller and supports the regulating member. The seal member is mounted on an inner surface of the wall in the vicinity of both ends of the developing roller with respect to the longitudinal direction thereof. The seal member makes contact with the outer surface of the developing roller, and presses against the outer surface. Consequently, the developing agent is prevented from leaking from a space for carrying the developing agent between the outer surface and the inner surface of the wall. The regulating member includes a protrusion, and the protrusion protrudes from the supporting member toward the developing roller. The length of the supporting member in the longitudinal direction is longer than the length of the protrusion in the longitudinal direction. The seal member includes an extending portion, the extending portion extends from the space for carrying the developing agent. The extending portion is turned backward along an end of the regulating member in the longitudinal direction toward the supporting member.

According to a preferred embodiment of the present invention, the seal member preferably includes a first seal member and a second seal member. The first seal member is preferably an elastic member, and comes into contact with an inner side of the housing wall. The second seal member preferably includes a sliding surface extending along the outer surface of the developing roller, and comes into contact with the surface of the developing roller.

According to a preferred embodiment of the present invention, the second seal member is preferably made of a resin including fluorine.

According to a preferred embodiment of the present invention, the first seal member is preferably formed of cellular rubber.

According to a preferred embodiment of the present invention, the developing agent includes toner and carrier which is a magnetic material. The carrier carries the toner by causing the toner to be adhered on a surface thereof.

Preferred embodiments of the invention provide an image forming device including the developing device described above and the photosensitive body on which the electrostatic latent image is formed on the outer surface thereof.

According to various preferred embodiments of the present invention, since the extending portion of the seal member is turned back toward the supporting member along the end of the regulating member with respect to the longitudinal direction thereof, the gap between the supporting member and the regulating member is reliably closed. Therefore, the developing agent is prevented from leaking from the gap.

According to a preferred embodiment of the present invention, the developing roller is pressed by a pressing force on the basis of an elastic force of the first seal member. The developing roller is rotated while being in contact with the sliding surface of the second seal member having a sliding resistance lower than that of the first seal member. Therefore, the outer surface of the developing roller can be pressed while adequately rotating the developing roller. Therefore, the developing agent is effectively prevented from leaking from the developing device.

According to a preferred embodiment of the present invention, the strength of magnetic fields in the vicinity of the ends of the developing roller with respect to the longitudinal direction is smaller than that in the vicinity of a center portion with respect to the longitudinal direction thereof. Therefore, napping of the carrier due to the magnetic force on both ends of the developing roller with respect to the longitudinal direction is reduced. Although deterioration of a sealing effect of the toner due to the napping of the carrier has been an issue in the prior art, according to this preferred embodiment, the toner is prevented from leaking through the gap irrespective of the lowering of the sealing effect.

Other features, elements, processes, steps, characteristics and advantages of the present invention will become more apparent from the following detailed description of preferred embodiments of the invention with reference to the attached drawings.

DETAILED DESCRIPTION OF PREFERRED EMBODIMENTS

Figure 1:
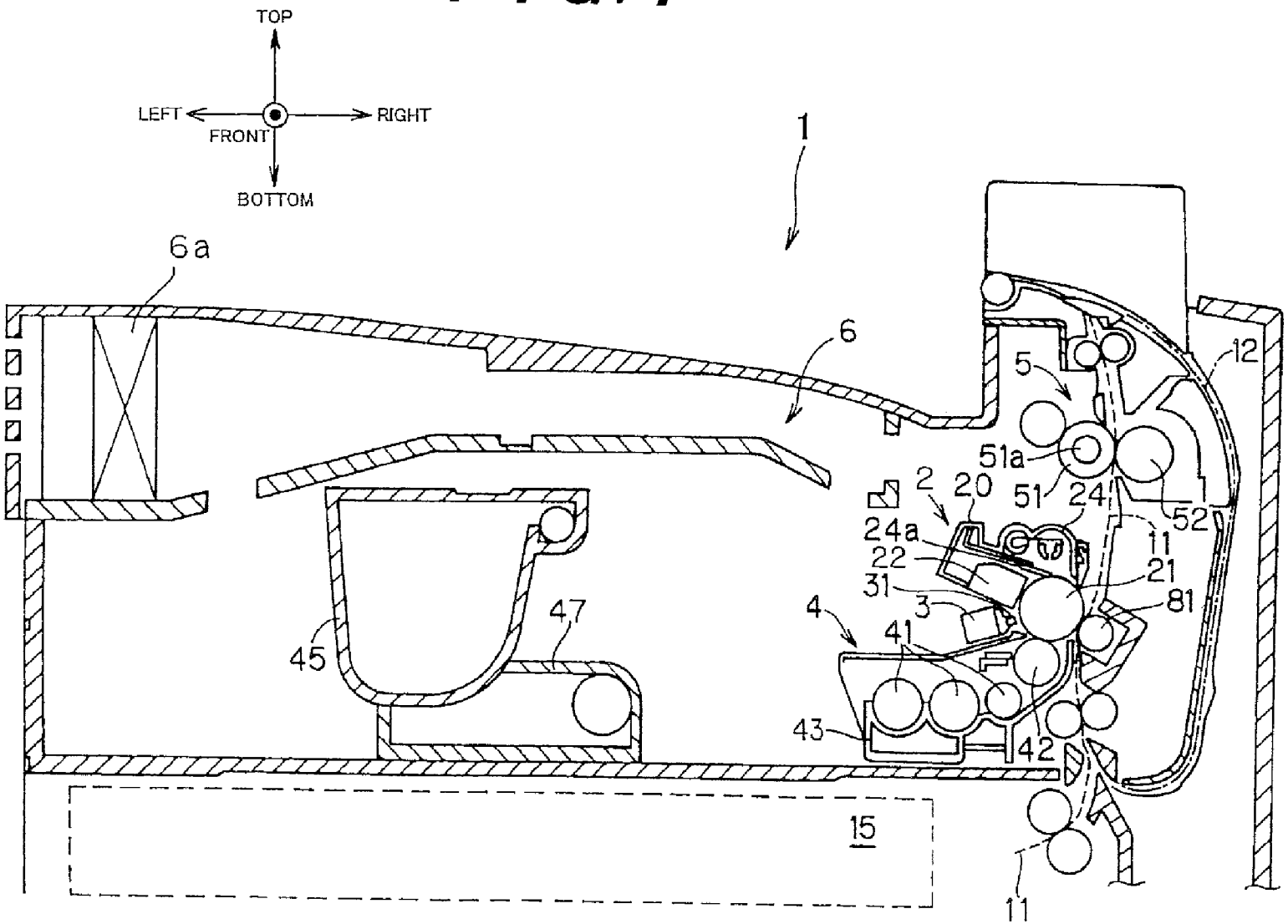
FIG. 1 is a front cross-sectional view showing an example of a structure of an image forming device according to a preferred embodiment of the present invention.

Referring to the drawings, preferred embodiments of the present invention will be described in detail.

1. Structure of the Image Forming Device

FIG. 1 is a front cross-sectional view showing an example of a structure of an image forming device 1 according to a preferred embodiment of the present invention. In the respective drawings, coordinate axes indicating the fore-and-aft direction, the lateral direction, and the vertical direction are shown as needed for clarifying directional relationships.

The image forming device 1 is preferably a scanner, a printer, a copying machine, a facsimile, or a multi function peripheral in which the functions of these machines are combined. As shown in FIG. 1, the image forming device 1 mainly includes an image forming unit 2, an exposing unit 3, a developing unit 4, and a fusing unit 5. The respective units 2 to 5 are provided above a paper feeding cassette 15. A duct 6 for discharging air in the image forming device 1 to the outside is provided in an upper portion of the image forming device 1.

An image forming process in the image forming device 1 will now be described briefly. An electrostatic latent image is formed on a photosensitive drum 21 of the image forming unit 2, and the electrostatic latent image is developed by toner from the developing unit 4. A developed toner image is transferred to recording paper which is fed from the paper feeding cassette 15. Subsequently, the toner image transferred on the recording paper is fused on the recording paper by the fusing unit 5. The recording paper after completion of the fusing process is outputted to a paper output tray (not shown) via a main transportation path 11 (a path indicated by a broken line in FIG. 1).

When printing is executed on both surfaces of the recording paper, the recording paper after completion of printing on one of the surfaces thereof is fed again to the image forming unit 2 via a reverse transportation path 12 (a path indicated by a chain line in FIG. 1). Then, in the image forming unit 2, the image forming process is executed on the other surface of the recording paper.

As shown in FIG. 1, the image forming unit 2 mainly includes a photosensitive drum 21, a charger 22, and a cleaning section 24. The charger 22 supplies an electrical charge (a negative electrical charge in this preferred embodiment) on an outer surface of the photosensitive drum 21. The image forming unit 2 is configured integrally with a frame 20, so as to be capable of being attached to and detached from the image forming device 1.

The photosensitive drum 21 has a photoconductive film on the outer surface thereof. The photosensitive drum 21 is used as a photosensitive body for electrophotography. As shown in FIG. 1, the photosensitive drum 21 makes contact with a developing roller 42 of the developing unit 4 and a transfer roller 81.

The cleaning section 24 collects toner which is not transferred from the photosensitive drum 21 and remains thereon. The collected and used waste toner is transported to a waste toner tank 47 by a transportation mechanism (not shown), and is accumulated in the waste toner tank 47. Therefore, in the image forming unit 2, a preferable image forming process can be executed without being affected by the remaining toner.

The exposing unit 3 includes a plurality of light emission elements (for example, LEDs (light emitting diodes) (not shown)) arranged substantially linearly. As shown in FIG. 1, the exposing unit 3 is arranged obliquely downwardly of the photosensitive drum 21. The light emission elements 31 are in proximity of the outer surface of the photosensitive drum 21.

When illumination control (exposure process) of the respective light emission elements 31 is executed on the basis of image data, electric charge is removed from a portion of the outer surface of the photosensitive drum 21 to which light is irradiated from the light emission elements 31. Consequently, the electrostatic latent image corresponding to the image data is formed on the outer surface of the photosensitive drum 21.

The developing unit 4 supplies toner to the outer surface of the photosensitive drum 21. Accordingly, the electrostatic latent image formed on the outer peripheral surface of the photosensitive drum 21 is developed. As shown in FIG. 1, the developing unit 4 mainly includes supplying rollers 41 and the developing roller 42. In this preferred embodiment, the developing unit 4 is integrally configured with a housing 43.

The developing unit 4 is capable of being attached to and detached from the image forming device 1.

In the image forming device 1 in this preferred embodiment, an electrophotographic system using a two-component developer is preferably used. Unused non-magnetic toner is stored in a toner tank 45. The unused non-magnetic toner is fed to the developing unit 4 from the toner tank 45, for example, according to the amount of toner in the housing 43 of the developing unit 4.

A carrier is stored in the housing 43 of the developing unit 4. The carrier is composed of ferromagnetic material such as iron powder or the like. When the carrier and the toner are stirred in the housing 43, the carrier and the toner are triboelectrified and are adsorbed to each other. In this manner, the carrier in this preferred embodiment causes the toner to be attached on the surface thereof and carries the same. The combination of the carrier and the toner is referred to as a "developing agent" in the description below.

The supplying rollers 41 are rotating rollers. The supplying rollers 41 supply the toner and the carrier from the interior of the housing 43 to the developing roller 42. The developing roller 42 receives the carrier and the toner supplied from the supplying rollers 41. Then, the developing roller 42 supplies the toner to the photosensitive drum 21 by an electrostatic force.

Figure 2:
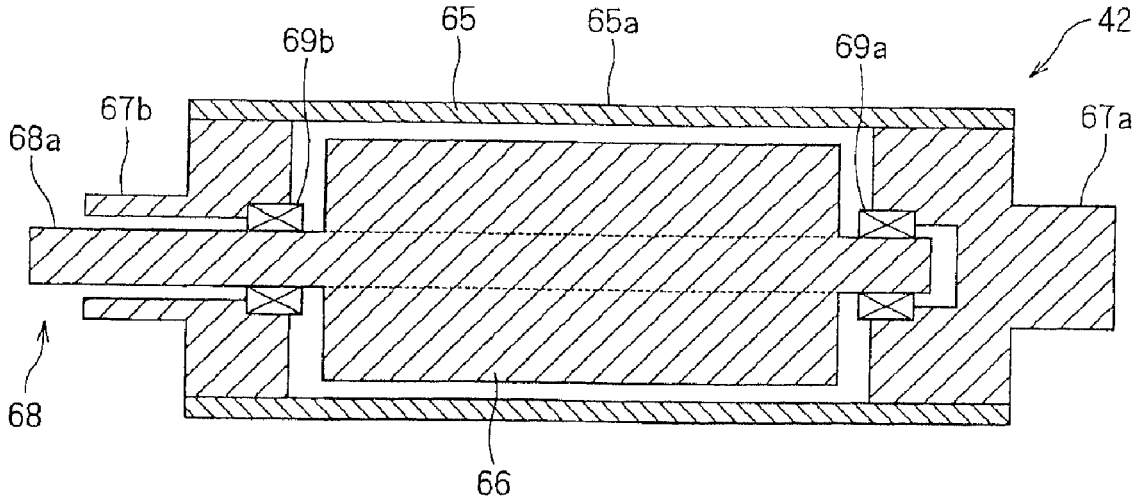
FIG. 2 is a cross-sectional top view showing an example of a structure of a developing roller.
Figure 2:
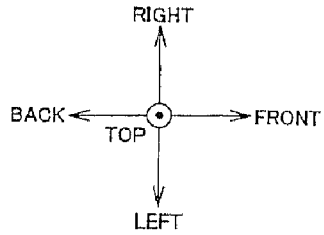

FIG. 2 is a cross-sectional top view showing an example of a structure of the developing roller 42. As shown in FIG. 2, the developing roller 42 mainly includes a sleeve 65, a magnet roller 66, and a shaft 68.

The sleeve 65 is a non-magnetic body such as aluminum formed into a hollow cylindrical shape. As shown in FIG. 2, flanges 67*a*, 67*b* are respectively provided on both ends of the sleeve 65 with respect to the longitudinal direction (the fore-and-aft direction). Bearings 69*a*, 69*b* are provided on the respective flanges 67*a*, 67*b*.

The magnet roller 66 is a permanent magnet having a substantially cylindrical shape. The magnet roller 66 is disposed in the sleeve 65. The magnet roller 66 is fixed to the shaft 68 and arranged so that the axial centers almost match. Both ends of the shaft 68 are supported by the bearings 69*a*, 69*b* corresponding thereto. The end 68*a* of the shaft 68 on the flange 67*b* side is fixed to a predetermined position in the housing 43 (see FIG. 1).

When a rotating force is applied to the flanges 67*a*, 67*b*, the sleeve 65 rotates around the static magnet roller 66. Magnetic brushing of the carrier and the toner occurs on an outer surface 65*a* by being napped by a magnetic force from a magnetic field formed by the magnet roller 66. In other words, the developing agent is held on the outer surface of the developing roller 42 by the magnetic force. The magnetic brush touches the photosensitive drum 21 and the toner is supplied from the developing roller 42 to the photosensitive drum 21.

The transfer roller 81 is arranged on the opposite side from the photosensitive drum 21 with respect to the main transportation path 11. A potential (positive potential in this preferred embodiment) having an opposite polarity from the photosensitive drum 21 is applied to the transfer roller 81. Accordingly, when the recording paper passes between the photosensitive drum 21 and the transfer roller 81, the toner on the outer surface of the photosensitive drum 21 is moved toward the transfer roller 81. Therefore, a toner image on the photosensitive drum 21 is transferred to the recording paper. Then, the recording paper on which the toner image is transferred is carried to the fusing unit 5.

The fusing unit 5 mainly includes a heat roller 51 and a press roller 52 as shown in FIG. 1. These rollers 51, 52 extend in the fore-and-aft direction. The heat roller 51 is preferably formed of metal (for example, aluminum) having high heat conductivity. A heater 51*a* is disposed in the interior of the heat roller 51, and the heater is, for example, a metal halide lamp. The press roller 52 is disposed on the opposite side from the heat roller 51 with respect to the main transportation path 11.

When the recording paper is carried to a nip between the heat roller 51 and the press roller 52, the recording paper is heated and pressed. Therefore, the transferred toner image is printed and fused on the recording paper.

2. Structure in the Vicinity of the Developing Roller

Figure 3:
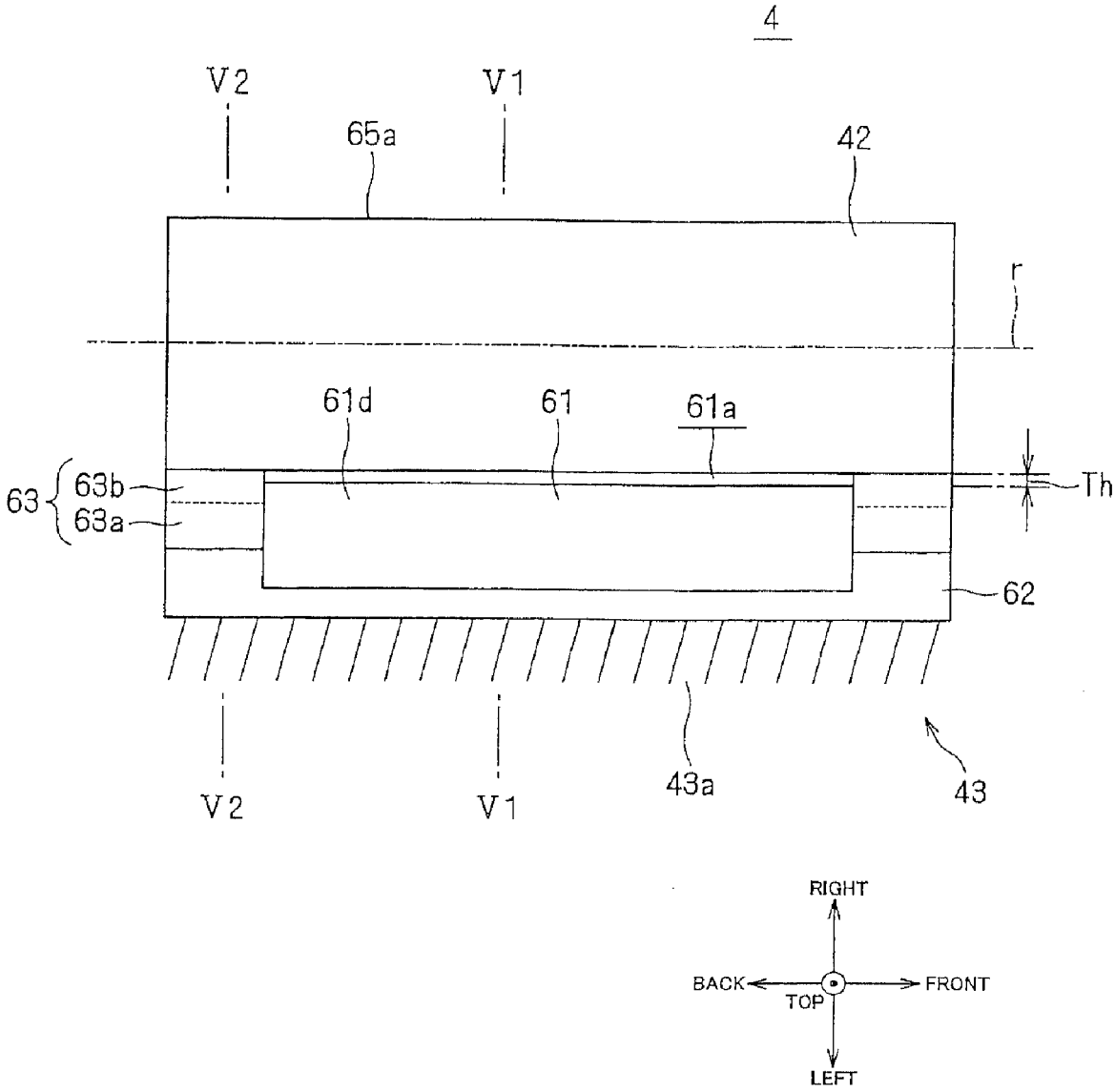
FIG. 3 is a top view of an example of a structure in the vicinity of the developing roller.
Figure 4:
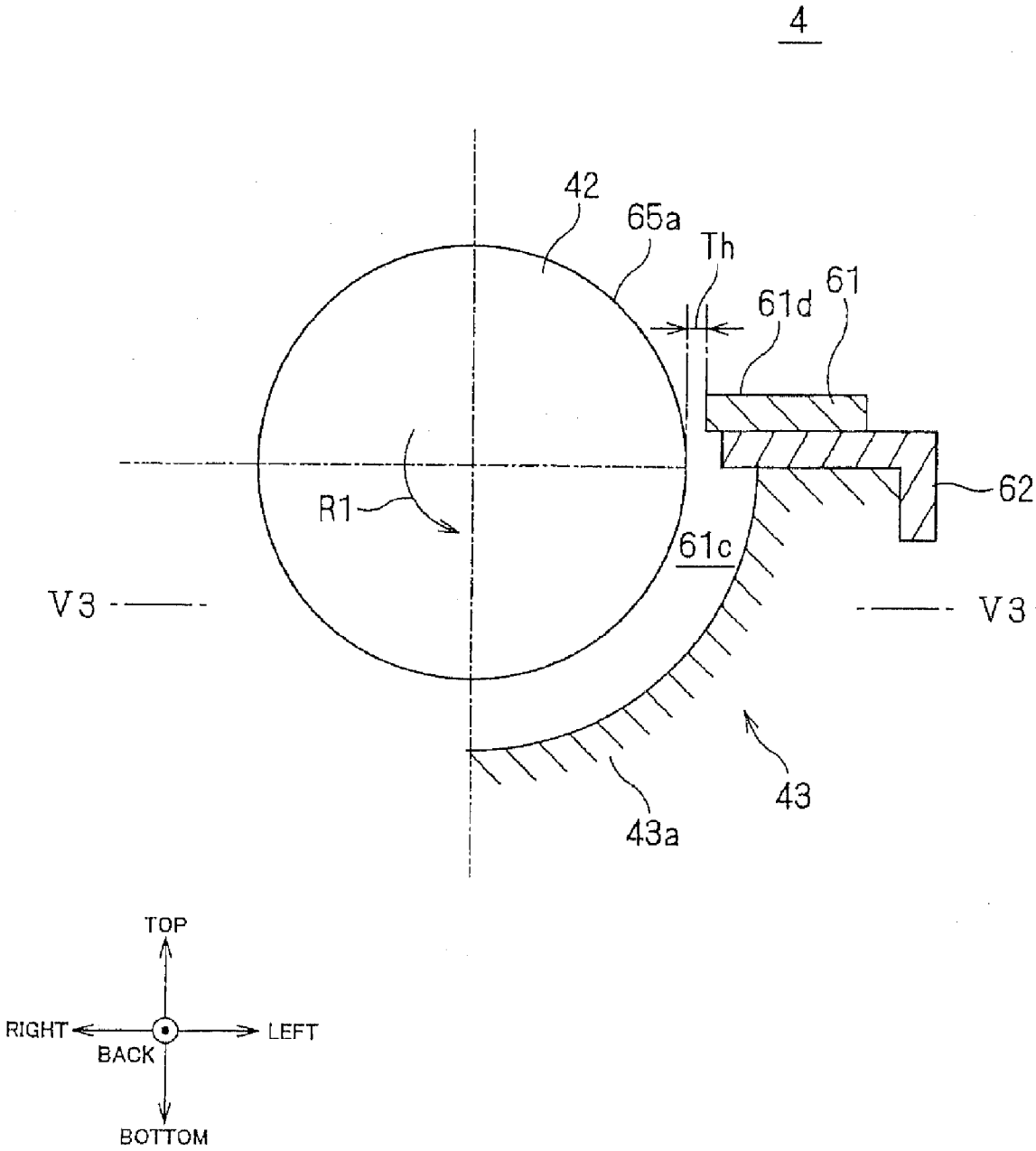
FIG. 4 is a drawing showing an example of a cross-section taken along the line VI-VI in FIG. 3.
Figure 5:
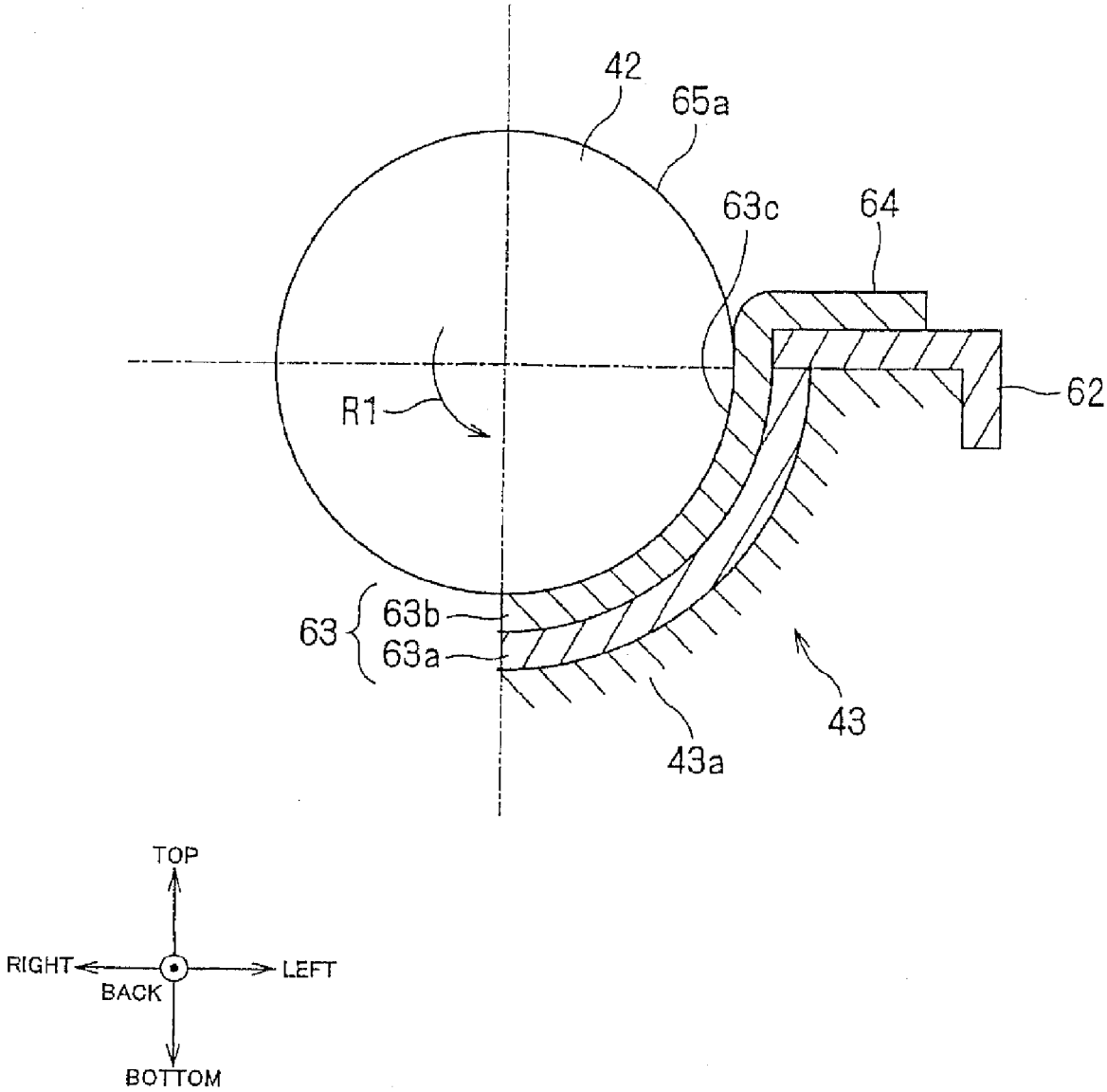
FIG. 5 is a drawing showing an example of a cross-section taken along the line V2-V2 in FIG. 3.
Figure 6:
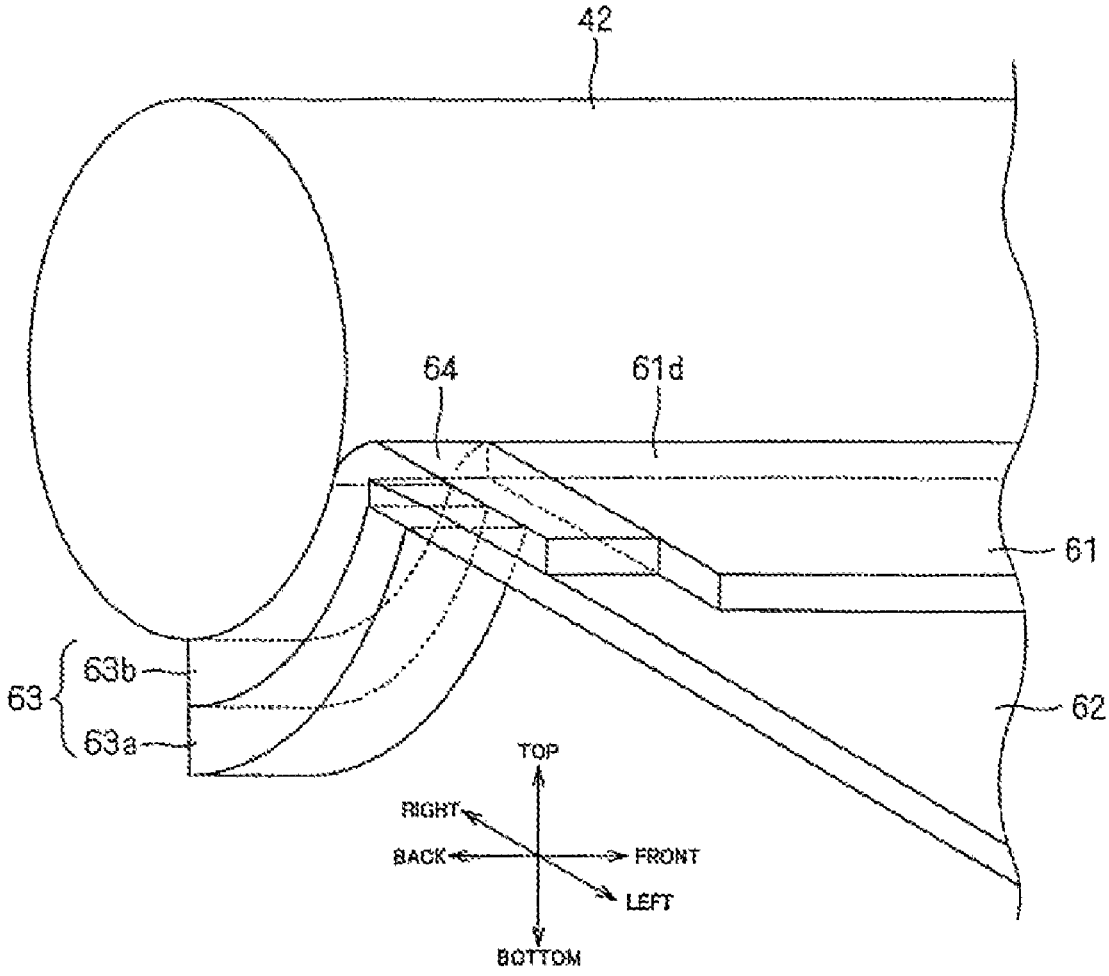
FIG. 6 is a perspective view showing an example of the structure in the vicinity of the developing roller.

FIG. 3 is a top view showing an example of the structure in the vicinity of the developing roller 42. FIG. 4 is a drawing showing an example of a cross-section taken along the line VI-VI in FIG. 3. FIG. 5 is a drawing showing an example of a cross-section taken along the line V2-V2 in FIG. 3. FIG. 6 is a perspective view showing the example of the structure in the vicinity of the developing roller 42. Referring to FIG. 3 to FIG. 6, the structure in the vicinity of the developing roller 42 will be described.

As shown in FIG. 3 to FIG. 5, the developing roller 42 is provided along an inner wall provided in the housing 43. A blade 61 is provided on the left side of the developing roller 42. The blade 61 regulates the layer thickness of the developing agent held on the outer surface 65*a* of the developing roller 42. As shown in FIG. 3, the blade 61 is disposed along the longitudinal direction (the fore-and-aft direction) of the developing roller 42.

A bracket 62 is provided on the left side of the developing roller 42. The bracket 62 supports the blade 61. As shown in FIG. 4 and FIG. 5, a lateral cross-section of the bracket 62 is preferably substantially L-shaped. The length of the bracket 62 in the longitudinal direction is longer than the length of the blade 61 in the longitudinal direction. In addition, the bracket 62 is arranged along the longitudinal direction of the developing roller 42, and is mounted on the inner wall 43*a* of the housing 43.

As shown in FIG. 4 and FIG. 6, an end of the blade 61 in the widthwise direction (lateral direction) is mounted to the bracket 62 so as to protrude toward the developing roller 42 from the bracket 62. In other words, the blade 61 has a protrusion 61*d* and the protrusion 61*d* protrudes toward the developing roller 42 from the bracket 62. In addition, as shown in FIG. 4, a space 61*c* for carrying the developing agent is defined between the outer surface 65*a* of the developing roller 42 and a surface on the inner wall 43*a*.

Therefore, when the developing roller 42 rotates in the direction of rotation R1, the layer thickness of the developing agent carried in the space 61*c* while being held on the outer surface 65*a* is regulated by the protrusion 61*d*. Consequently, the value of the layer thickness of the developing agent becomes smaller than "Th".

A seal member 63 is provided in the vicinity of both ends of the developing roller 42 with respect to the longitudinal direction thereof. The seal member 63 is provided on the surface of the inner wall 43*a*. The seal member 63 makes contact with the outer surface 65*a* of the developing roller 42 and presses against the outer surface 65*a*. Therefore, the developing agent is prevented from leaking from the space 61*c* for carrying the developing agent. As shown in FIG. 3 and FIG. 6, the sealing member 63 is arranged between the end of the blade 61 with respect to the longitudinal direction and the end of the developing roller 42 with respect to the longitudinal direction. The seal member 63 includes an elastic member (first seal member) 63*a* and a sliding member (second seal member) 63*b*.

The elastic member 63*a* is preferably formed of an elastic body such as urethane rubber. The elastic member 63*a* is provided on the inner wall 43*a* side. As shown in FIG. 5 and FIG. 6, the elastic member 63*a* is mounted on the surface of the inner wall 43*a*, and the height of an upper end surface of the elastic member 63*a* is substantially flush with the height of a lower surface of the bracket 62.

The sliding member 63*b* has an extremely small friction coefficient, and is preferably made of a resin including fluorine, for example. The sliding member 63*b* is provided on the developing roller 42 side. As shown in FIG. 5, the sliding member 63*b* has a sliding surface 63*c*, and the sliding surface 63*c* extends along the outer surface 65*a* of the developing roller 42. The sliding surface 63*c* preferably has a sliding resistance lower than the elastic member 63*a*. As shown in FIG. 5 and FIG. 6, the sliding member 63*b* includes an extending portion 64, and the extending portion 64 extends from the space 61*c* for carrying the developing agent (see FIG. 4). The extending portion 64 is turned back along the end of the blade 61 with respect to the longitudinal direction.

Figure 7:
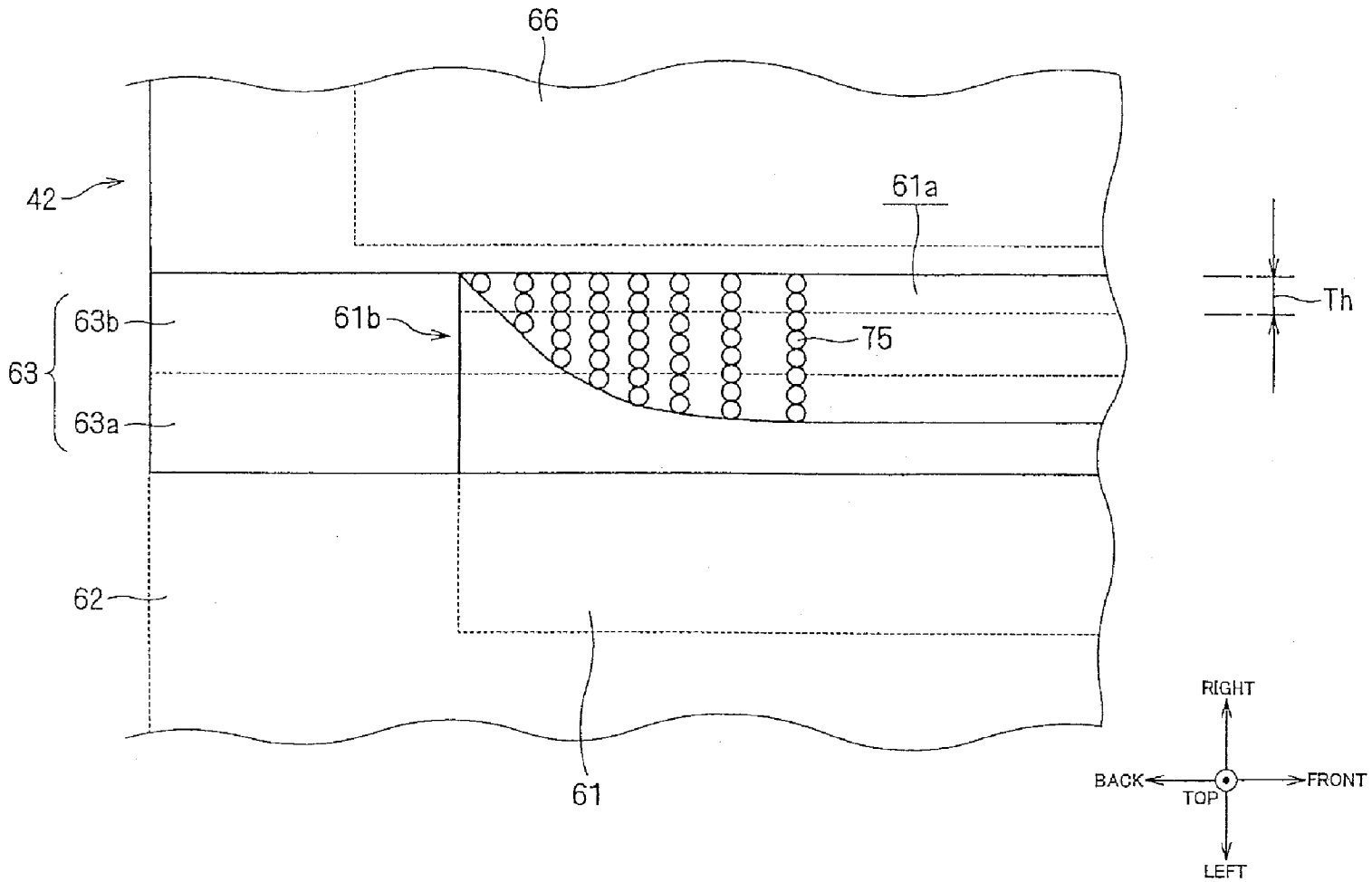
FIG. 7 is an explanatory drawing showing a state of adhesion of a carrier adhered on an outer surface of the developing roller.
Figure 8:
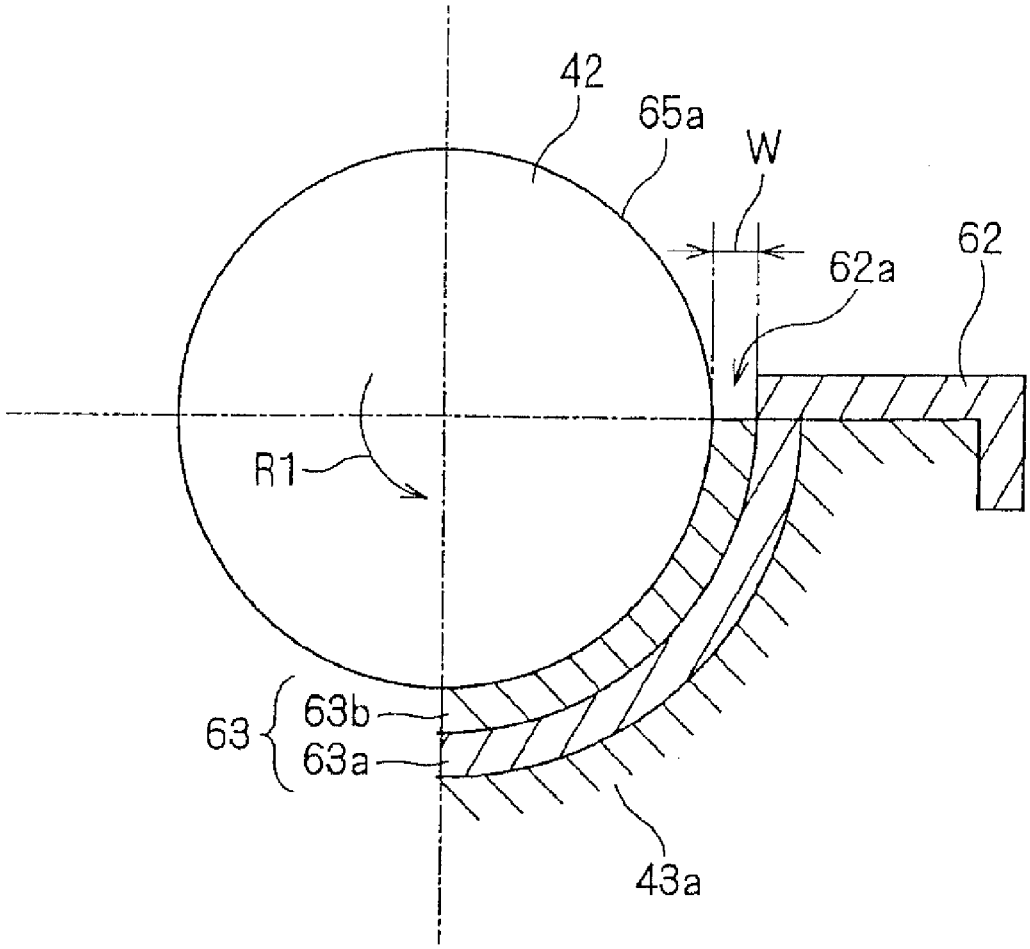
FIG. 8 PRIOR ART
FIG. 8 is a side cross-sectional view showing a portion in the vicinity of an end of a developing roller in the longitudinal direction in a conventional device.
Figure 8:
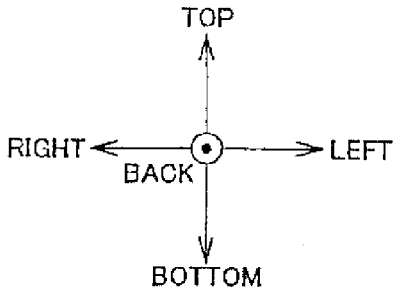
FIG. 8 PRIOR ART
Figure 9:
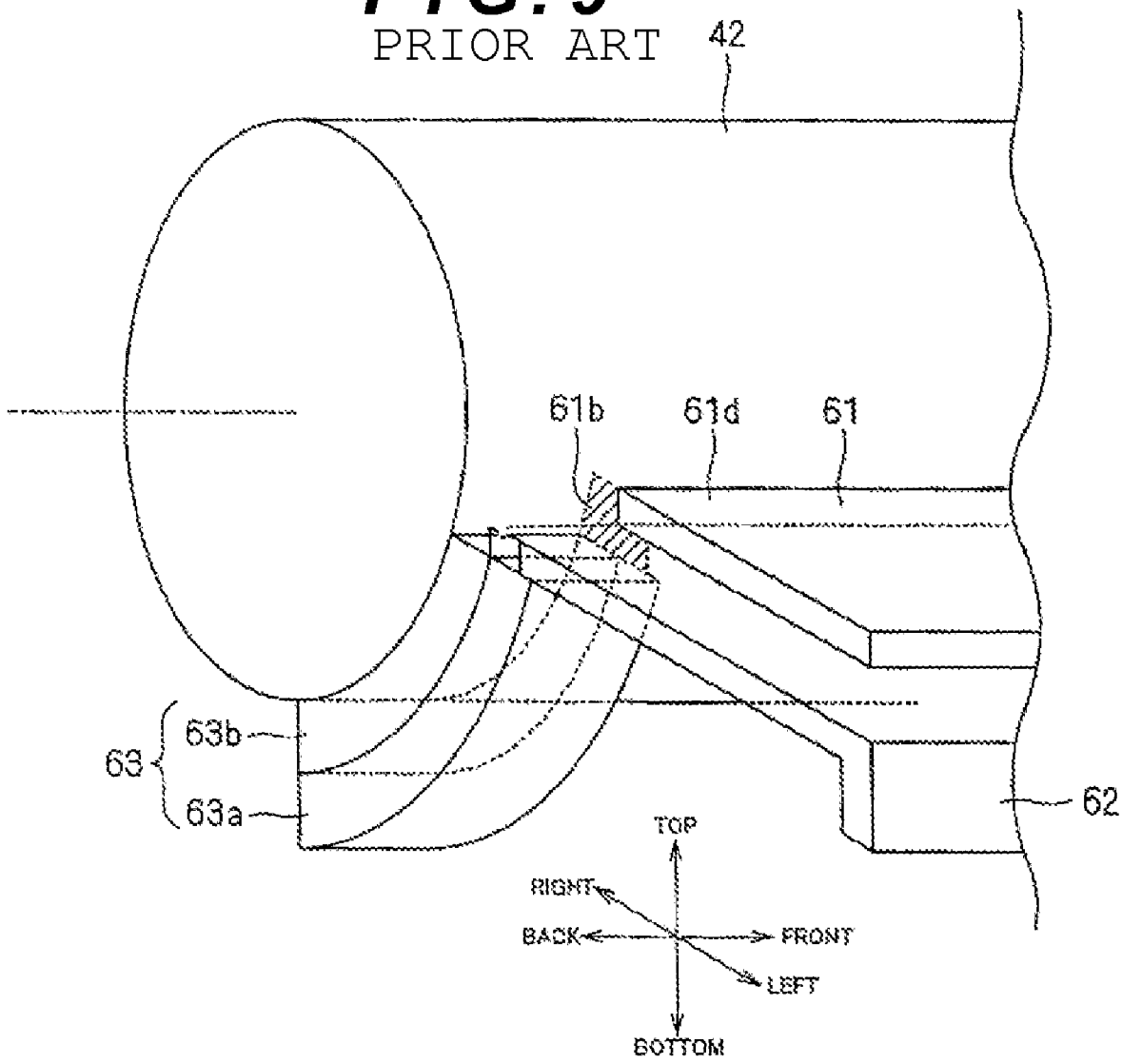
FIG. 9 PRIOR ART
FIG. 9 is a perspective view showing another example of the structure of the portion in the vicinity of the developing roller in a conventional device.

FIG. 7 is an explanatory drawing showing a state of adhesion of carrier 75 adhered on the outer surface 65*a* of the developing roller 42. FIG. 8 is a drawing of a conventional device in which the view is similar to a cross-section taken along the line V2-V2 of FIG. 3, but the structure of FIG. 8 does include an extending portion provided on the sliding member 63*b* as in the preferred embodiment of the present invention shown in FIG. 3. FIG. 9 is a perspective view showing the conventional structure in the vicinity of the developing roller 42 in which an extending portion is not provided on the sliding member 63*b*.

FIG. 9 shows a conventional case in which the extending portion is not provided on the sliding member 63*b* and the height of the upper end of the sliding member 63*b* is substantially flush with the lower surface of the bracket 62. In this case, a gap 61*b* is defined in an area surrounded by the outer surface of the developing roller 42, the protrusion 61*d* of the blade 61, the bracket 62, and the seal member 63 as described above.

As shown in the conventional device of FIG. 8, the width W of an opening 62*a* defined between an end of the bracket 62 with respect to the widthwise direction and the outer surface 65*a* of the developing roller 42 is on the order of about 0.3 mm to about 1.0 mm. Therefore, it is very difficult to close the opening 62*a* with a separate member other than the seal member 63.

As shown in FIG. 7, in the developing unit 4 in this preferred embodiment, an opening 61*a* is almost closed by napping of the carrier 75 due to the magnetic force from the developing roller 42. In other words, in the developing unit 4, the toner or the carrier 75 is prevented from leaking from the opening 61*a* in the space 61*c* for carrying the developing agent by the sealing effect by the napping of the carrier 75.

However, in the developing roller 42 shown in FIG. 2, it is known that the strength of the magnetic field in the vicinity of the end of the developing roller 42 is lowered in comparison with the portion near the center thereof with respect to the longitudinal direction. Moreover, it is known that the height of the napping of the carrier 75 is proportional to the strength of the magnetic field. Therefore, as shown in FIG. 7, the napping of the carrier 75 is lowered in the vicinity of the end of the developing roller 42 with respect to the longitudinal direction, and the sealing effect in the vicinity of the developing roller 42 with respect to the longitudinal direction is lowered.

Consequently, there arises a problem such that the toner or the carrier 75 may leak through the gap 61*b* described above. The toner may also leak through the gap 61*b* in the case in which a fine electric movement is applied to the toner or the carrier 75 carried by the developing roller 42 or a force that overcomes the magnetic field from the developing roller 42 is applied.

In contrast, in this preferred embodiment of the present invention, the extending portion 64 is turned back toward the bracket 62. Accordingly, the gap 61*b* is closed by a portion of the seal member 63, which is not a separate member. The developing roller 42 is pressed by a pressing force based on the elasticity of the elastic member 63*a*. In addition, the developing roller 42 is rotated while being in contact with the sliding surface 63*c* of the sliding member 63*b* having a lower sliding resistance than the elastic member 63*a*.

Therefore, the developing unit 4 of this preferred embodiment can maintain the rotating performance of the developing roller 42. The leaking of the developing agent from the developing unit 4 is reliably and easily prevented. Since the gap 61*b* can be closed by the extending portion 64, the developing agent can be desirably prevented from leaking irrespective of lowering of the sealing effect due to the napping of the developing agent.

3. Modifications

Although preferred embodiments of the present invention have been described above, the present invention is not limited to the above-described preferred embodiments and various modifications can be made.

In the description of the above described preferred embodiments, the photosensitive drum 21 and the toner are negatively charged, and the transfer roller 81 is positively charged. However, the present invention is not limited thereto. For example, it is also possible to positively charge the photosensitive drum 21 and the toner, and the transfer roller 81 is negatively charged, respectively.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. A developing device for developing an electrostatic latent image formed on a photosensitive body, comprising:

a housing including an inner wall;

a developing roller provided along the inner wall and holding developing agent on an outer surface thereof by a magnetic force;

a regulating member provided along a longitudinal direction of the developing roller and arranged to regulate the layer thickness of the developing agent held on the outer surface of the developing roller;

a supporting member provided along the longitudinal direction of the developing roller and arranged to support the regulating member;

a seal member mounted on a surface of the inner wall in the vicinity of both ends of the developing roller with respect to the longitudinal direction thereof, and arranged to make contact with the outer surface of the developing roller and press against the outer surface thereof so as to prevent the developing agent from leaking from a space for carrying the developing agent between the outer surface of the developing roller and the surface of the inner wall; wherein the regulating member includes a protrusion, and the protrusion protrudes from the supporting member toward the developing roller;

the length of the supporting member in the longitudinal direction is longer than the length of the protrusion in the longitudinal direction;

the seal member includes an extending portion extending from the space for carrying the developing agent;

the extending portion is turned backward along an end of the regulating member with respect to the longitudinal direction thereof toward the supporting member;

the developing agent includes toner and a carrier, the carrier includes a magnetic material;

an opening defined in a radial direction between an edge of the supporting member closest to the developing roller and the outer surface of the developing roller is almost closed by the carrier in response to magnetic force provided by the developing roller; and a gap defined at a position surrounded by the outer surface of the developing roller, the protrusion of the regulating member, the supporting member, and the seal member is closed by a portion of the seal member.

2. The developing device according to claim 1, wherein the seal member includes a first seal member provided along the inner wall and including an elastic member, and a second seal member provided along the developing roller and having a sliding surface along the outer surface of the developing roller, wherein the sliding surface has a sliding resistance lower than that of the first seal member.

3. The developing device according to claim 2, wherein the second seal member is made of a resin including fluorine.

4. The developing device according to claim 3, wherein the first seal member is made of cellular rubber.

5. The developing device according to claim 2, wherein the first seal member is made of cellular rubber.

6. The developing device according to claim 2, wherein the extending portion is defined on the second seal member and not on the first seal member.

7. An image forming device comprising:

a photosensitive body; and a developing device for developing an electrostatic latent image formed on the photosensitive body, the developing device including:

a housing including an inner wall;

a developing roller provided along the inner wall and holding developing agent on an outer surface thereof by a magnetic force;

a regulating member provided along a longitudinal direction of the developing roller and arranged to regulate the layer thickness of the developing agent held on the outer surface;

a supporting member provided along the longitudinal direction of the developing roller and arranged to support the regulating member;

a seal member mounted on a surface of the inner wall in the vicinity of both ends of the developing roller with respect to the longitudinal direction thereof, and arranged to make contact with the outer surface of the developing roller and press against the outer surface thereof so as to prevent the developing agent from leaking from a space for carrying the developing agent between the outer surface and the surface of the inner wall; wherein the regulating member includes a protrusion, and the protrusion protrudes from the supporting member toward the developing roller;

the length of the supporting member in the longitudinal direction is longer than the length of the protrusion in the longitudinal direction;

the seal member includes an extending portion extending from the space for carrying the developing agent;

the extending portion is turned backward along an end of the regulating member with respect to the longitudinal direction thereof toward the supporting member;

the developing agent includes toner and a carrier, the carrier includes a magnetic material;

an opening defined in a radial direction between an edge of the supporting member closest to the developing roller and the outer surface of the developing roller is almost closed by the carrier in response to magnetic force provided by the developing roller; and a gap defined at a position surrounded by the outer surface of the developing roller, the protrusion of the regulating member, the supporting member, and the seal member is closed by a portion of the seal member.

8. The image forming device according to claim 7, wherein the seal member includes a first seal member provided along the inner wall and including an elastic member, and a second seal member provided along the developing roller and having a sliding surface along the outer surface, and the sliding surface has a sliding resistance lower than that of the first seal member.

9. The image forming device according to claim 8, wherein the second seal member is made of a resin including fluorine.

10. The image forming device according to claim 9, wherein the first seal member is made of cellular rubber.

11. The image forming device according to claim 8, wherein the first seal member is made of cellular rubber.

12. The developing device according to claim 8, wherein the extending portion is defined on the second seal member and not on the first seal member.

* * * * *

UNITED STATES PATENT AND TRADEMARK OFFICE

CERTIFICATE OF CORRECTION

PATENT NO. : 7,668,481 B2
APPLICATION NO. : 11/466790
DATED : February 23, 2010
INVENTOR(S) : Hideaki Kawai It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 737 days.

Signed and Sealed this

Seventh Day of December, 2010

David J. Kappos

David J. Kappos
*Director of the United States Patent and Trademark Office*